US007298199B2

(12) United States Patent
Jung et al.

(10) Patent No.: US 7,298,199 B2
(45) Date of Patent: Nov. 20, 2007

(54) SUBSTRATE BIAS VOLTAGE GENERATING CIRCUIT FOR USE IN A SEMICONDUCTOR MEMORY DEVICE

(75) Inventors: Han-Gyun Jung, Seoul (KR); Chi-Wook Kim, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/291,194

(22) Filed: Dec. 1, 2005

(65) Prior Publication Data

US 2006/0290412 A1 Dec. 28, 2006

(30) Foreign Application Priority Data

Jun. 28, 2005 (KR) ..... 10-2005-0056500

(51) Int. Cl.
*G05F 1/10* (2006.01)

(52) U.S. Cl. ..... 327/536; 363/59

(58) Field of Classification Search ..... 327/534–537; 323/59–60; 365/189.09
See application file for complete search history.

(56) References Cited

U.S. PATENT DOCUMENTS 5,451,891 A * 9/1995 Tanabe ..... 327/89
5,742,197 A * 4/1998 Kim et al. ..... 327/537
5,796,293 A * 8/1998 Yoon et al. ..... 327/536
5,877,651 A * 3/1999 Furutani ..... 327/538
6,020,780 A * 2/2000 Ozeki ..... 327/540
6,329,869 B1 * 12/2001 Matano ..... 327/536
6,654,296 B2 * 11/2003 Jang et al. ..... 365/189.09
6,700,434 B2 * 3/2004 Fujii et al. ..... 327/534
6,724,242 B2 * 4/2004 Kim et al. ..... 327/536
6,765,428 B2 * 7/2004 Kim et al. ..... 327/534
7,099,223 B2 * 8/2006 Do ..... 365/226

FOREIGN PATENT DOCUMENTS

| | | |
|---|---|---|
| JP | 07-244123 | 9/1995 |
| JP | 09-282874 | 10/1997 |
| JP | 10-199261 | 7/1998 |
| JP | 2002-056678 | 2/2002 |
| KR | 1999-001992 | 1/1999 |
| KR | 1020040051743 A | 6/2004 |

* cited by examiner

*Primary Examiner*—Kenneth B. Wells
*Assistant Examiner*—Thomas J. Hiltunen
(74) *Attorney, Agent, or Firm*—F. Chau & Associates, LLC

(57) ABSTRACT

A substrate voltage generating circuit for use in a semiconductor memory device is provided. The semiconductor memory device includes a charge pump for generating a substrate bias voltage in response to a clock signal; a first inverter type detector for detecting whether the substrate bias voltage reaches a target voltage; a second differential amplifier type detector for detecting whether the substrate bias voltage reaches the target voltage; and a driver for generating the clock signal in response to an output of one of the first and second detectors.

14 Claims, 6 Drawing Sheets

SUBSTRATE BIAS VOLTAGE GENERATING CIRCUIT FOR USE IN A SEMICONDUCTOR MEMORY DEVICE

BACKGROUND OF THE INVENTION

1. Technical Field

The present invention is related to a semiconductor memory device, and more particularly, to a substrate bias voltage generating circuit for use in a semiconductor memory device.

2. Discussion of the Related Art

A semiconductor memory device typically includes a substrate bias voltage generating circuit for generating a substrate bias voltage. The substrate bias voltage is applied to a P-well/substrate surrounding MOS transistors of the semiconductor memory device to obtain some of the following effects.

For example, the substrate bias voltage is applied to a P-well/substrate to increase a threshold voltage of a parasitic MOS transistor. In addition, the substrate bias voltage is applied to a P-well/substrate to reduce the need for increasing the concentration of channel stop implants below a field oxide. This has been shown to improve junction breakdown and reduce leakage current. Further, the substrate bias voltage is applied to a P-well/substrate to reduce increases in a threshold voltage or a body effect of MOS transistors, thus reducing a junction capacitance at an end of a field oxide.

When the substrate bias voltage is applied to a P-well/substrate in a memory cell of a semiconductor memory device, leakage current of a storage node N+ layer connected to a cell capacitor is reduced, thereby increasing data retention time of the memory cell. In addition, since the data retention time is closely related to DRAM refresh time, the applied substrate bias voltage also affects the DRAM refresh time. Further, since the property of a cell transistor having the shortest channel in a chip embodying the semiconductor memory device is improved, a threshold voltage of the cell transistor can be suppressed. This has also been shown to reduce a boosted width of a word line voltage.

Exemplary substrate bias voltage generating circuits are disclosed in U.S. Pat. No. 5,744,997 entitled "SUBSTRATE BIAS VOLTAGE CONTROLLING CIRCUIT IN SEMICONDUCTOR MEMORY DEVICE", U.S. Pat. No. 6,198,341 entitled "SUBSTRATE BIAS VOLTAGE GENERATING CIRCUIT FOR USE IN A SEMICONDUCTOR DEVICE", U.S. Pat. No. 6,882,215 entitled "SUBSTRATE BIAS GENERATOR IN SEMICONDUCTOR MEMORY DEVICE", U.S. Pat. No. 6,906,967 entitled "NEGATIVE DROP VOLTAGE GENERATOR IN SEMICONDUCTOR MEMORY DEVICE AND METHOD OF CONTROLLING NEGATIVE VOLTAGE GENERATION", and Korea Patent Laid-Open No. 2001-0107692 entitled "SUBSTRATE VOLTAGE SENSING CIRCUIT AND SUBSTRATE VOLTAGE GENERATING CIRCUIT", the disclosures of which are incorporated herein in their entirety by reference.

FIG. 1 is a block diagram showing a conventional substrate bias voltage generating circuit, and FIGS. 2A and 2B are circuit diagrams showing exemplary embodiments of a detector illustrated in FIG. 1.

As illustrated in FIG. 1, a substrate bias voltage generating circuit 10 consists of a charge pump 12, a detector 14, and a driver 16. The charge pump 12 generates a substrate bias voltage $V_{BB}$ in response to a clock signal CLK, and the substrate bias voltage $V_{BB}$ is supplied to a substrate (not shown). The detector 14 detects whether the substrate bias voltage $V_{BB}$ maintains a predetermined negative voltage, and generates a detection signal DET as a detection result. The driver 16 generates the clock signal CLK in response to the detection signal DET.

The detector 14 may be one of two detector types, they are: an inverter type and a differential amplifier type. An inverter type detector is illustrated in FIG. 2A and a differential amplifier type detector is illustrated in FIG. 2B. Examples of the inverter type and differential amplifier type detectors are disclosed in the above-mentioned references U.S. Pat. No. 5,744,997 and Korea Patent Laid-Open No. 2001-0107692, respectively.

Referring now to FIG. 2A, an inverter type detector 14 receives an internal power supply voltage Vint and a substrate bias voltage $V_{BB}$ to generate a detection signal DET. The detector 14 has a voltage divider structure and generates the detection signal DET as a control signal for operating the charge pump 12 according to the substrate bias voltage $V_{BB}$.

Since the detector 14 operates simultaneously with the generation of the internal power supply voltage Vint at power-up, a substrate bias voltage of a desired level may be rapidly set up. On the other hand, it is difficult for the detector 14 to stably maintain the substrate bias voltage $V_{BB}$ in view of temperature variations, thus causing deterioration of the DRAM refresh time.

As shown in FIG. 2B, a differential amplifier type detector 14 consists of a voltage dividing section 14*a* and a differential amplifier section 14*b*. The voltage dividing section 14*a* receives a substrate bias voltage $V_{BB}$ and an internal power supply voltage Vint and divides the received voltages $V_{BB}$ and Vint based on a predetermined resistance ratio. The voltage dividing section 14*a* outputs a divided voltage Vdiv to the differential amplifier section 14*b*. The differential amplifier section 14*b* compares the divided voltage Vdiv and a reference voltage Vref and outputs a detection signal DET.

Since the detector 14 in FIG. 2B uses a differential amplifier, it detects the substrate bias voltage more exactly than the detector 14 in FIG. 2A. In addition, since the voltage dividing section 14*a* generates the divided voltage Vdiv according to the resistance ratio, the detector 14 is capable of maintaining the substrate bias voltage $V_{BB}$ in view of temperature variations. However, the detector 14 in FIG. 2B has a set up time that is slow at power-up.

For example, since the differential amplifier section 14*b* uses the reference voltage Vref and the divided voltage Vdiv as its input voltages, as illustrated in FIG. 3, the divided voltage Vdiv is lower than the reference voltage Vref until it reaches a predetermined voltage. For this reason, the detector 14 does not operate during a predetermined period of time at power-up, thus resulting in a slow set up time.

Accordingly, a need exists for a substrate bias voltage generating circuit for use with a semiconductor memory device that is capable of maintaining a stable bias voltage during and after power-up.

SUMMARY OF THE INVENTION

An embodiment of the present invention provides a substrate bias voltage generating circuit which comprises a charge pump for generating a substrate bias voltage in response to a clock signal; a first inverter type detector for detecting whether the substrate bias voltage reaches a target voltage; a second differential amplifier type detector for detecting whether the substrate bias voltage reaches the target voltage; and a driver for generating the clock signal in response to an output of one of the first and second detectors.

The first detector operates when the second detector does not operate and the second detector operates when the first detector does not operate. The first detector operates before an operating mode of a memory device is set up. The second detector operates after the operating mode of a memory device is set up.

The substrate bias voltage generating circuit further comprises a selector for generating a selection signal in response to a flag signal indicating whether an operating mode of a memory device is set up.

The selector comprises: an RS flip-flop; a first inverter connected to an output of the RS flip-flop; and a second inverter connected to a second input of the RS flip-flop, a first input of the RS flip-flop for receiving an input signal indicating whether a power supply voltage has reached a predetermined voltage, the second inverter for receiving the flag signal and the first inverter for outputting the selection signal.

Before the operating mode is set up, the first detector detects the substrate bias voltage in response to the selection signal.

The first detector comprises: an inverter type detection section; and a switch connected to the inverter type detection section, the switch for receiving an output of the inverter type detection section and the selection signal and outputting a first detection signal in response to the selection signal.

After the operating mode is set up, the second detector detects the substrate bias voltage in response to the selection signal.

The second detector comprises: a differential amplifier type detection section; and a switch connected to the differential amplifier type detection section, the switch for receiving an output of the differential amplifier type detection section and the selection signal and outputting a second detection signal in response to the selection signal.

Another embodiment of the present invention provides a semiconductor memory device which comprises a memory cell array; a control circuit for generating a flag signal indicating whether an operating mode is set up; and a substrate bias voltage generating circuit for generating a substrate bias voltage to be supplied to the memory cell array in response to the flag signal, wherein the substrate bias voltage generating circuit comprises a first inverter type detector and a second differential amplifier type detector, the first and second detectors selectively operating according to whether the flag signal is generated.

The substrate bias voltage generating circuit further comprises a charge pump for generating the substrate bias voltage in response to a clock signal; and a driver for generating the clock signal in response to an output of one of the first and second detectors.

The substrate bias voltage generating circuit further comprises a selector for generating a selection signal in response to the flag signal.

The selector comprises: an RS flip-flop; a first inverter connected to an output of the RS flip-flop; and a second inverter connected to a second input of the RS flip-flop, a first input of the RS flip-flop for receiving an input signal indicating whether a power supply voltage has reached a predetermined voltage, the second inverter for receiving the flag signal and the first inverter for outputting the selection signal.

Before the operating mode is set up, the first detector detects the substrate bias voltage in response to the selection signal.

The first detector comprises: an inverter type detection section; and a switch connected to the inverter type detection section, the switch for receiving an output of the inverter type detection section and the selection signal and outputting a first detection signal in response to the selection signal.

After the operating mode is set up, the second detector detects the substrate bias voltage in response to the selection signal.

The second detector comprises: a differential amplifier type detection section; and a switch connected to the differential amplifier type detection section, the switch for receiving an output of the differential amplifier type detection section and the selection signal and outputting a second detection signal in response to the selection signal.

Yet another embodiment of the present invention provides a method for generating a substrate bias voltage, comprising: generating, at a charge pump, the substrate bias voltage in response to a clock signal; detecting, at a first inverter type detector, whether the substrate bias voltage reaches a target voltage; detecting, at a second differential amplifier type detector, whether the substrate bias voltage reaches the target voltage; and generating, at a driver, the clock signal in response to an output of one of the first and second detectors.

The method further comprises: receiving, at a selector, a flag signal indicating whether an operating mode is set up; generating, at the selector, a selection signal in response to the flag signal; and performing one of operating the first inverter type detector in response to a first level of the selection signal and operating the second differential amplifier type detector in response to a second level of the selection signal.

BRIEF DESCRIPTION OF THE DRAWINGS

The above and other features of the present invention will become more apparent by describing in detail exemplary embodiments thereof with reference to the attached drawings in which.

DESCRIPTION OF EXEMPLARY EMBODIMENTS

Figure 4:
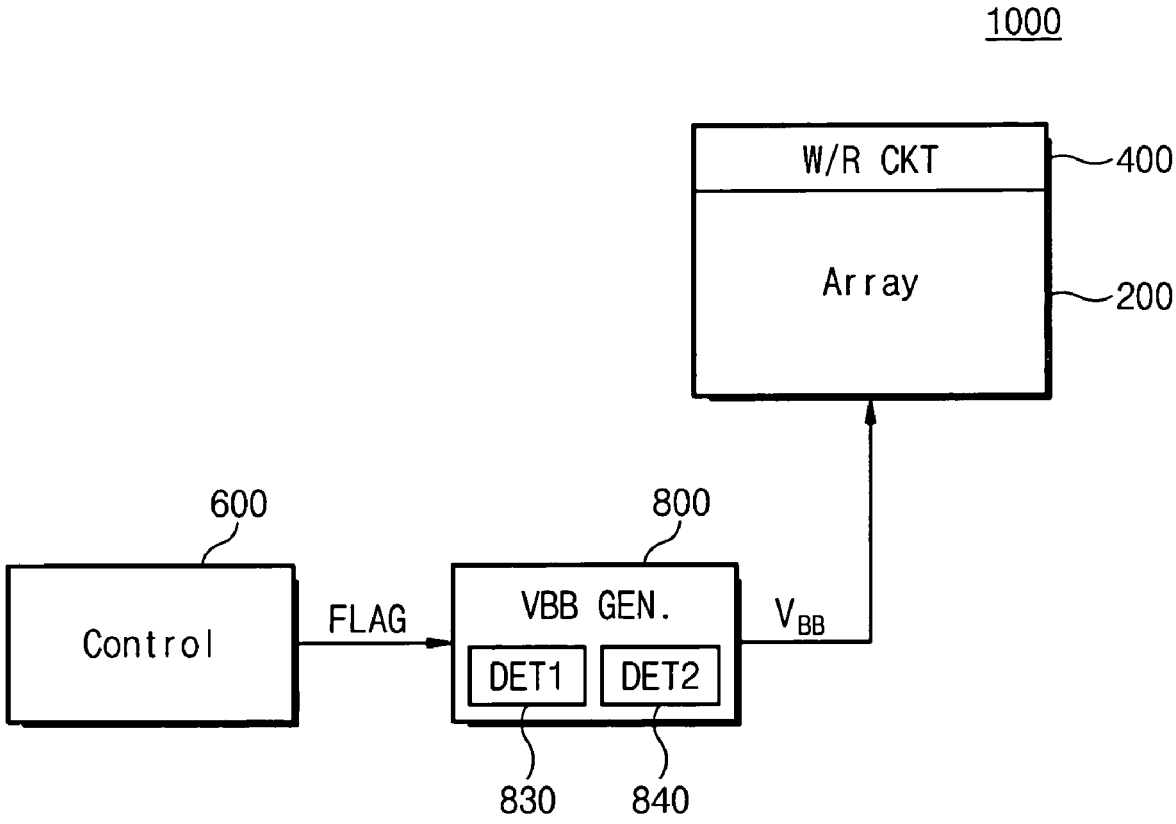
FIG. 4 is a block diagram showing a semiconductor memory device according to an exemplary embodiment of the present invention.

FIG. 4 is a block diagram showing a semiconductor memory device according to an exemplary embodiment of the present invention.

Referring to FIG. 4, a semiconductor memory device 1000 comprises a memory cell array 200; a write/read circuit 400 for writing/reading data to/from the memory cell array 200; a control circuit 600 for generating a flag signal FLAG;

and a substrate bias voltage generating circuit 800 for generating a substrate bias voltage $V_{BB}$ to be supplied to the memory cell array 200 in response to the flag signal FLAG.

In particular, the substrate bias voltage generating circuit 800 comprises two detectors 830 and 840 for detecting the substrate bias voltage $V_{BB}$. The detectors 830 and 840 selectively operate according to the flag signal FLAG output from the control circuit 600. The detectors 830 and 840 are configured to be detector types whose operating characteristics are different from each other. In this embodiment, the control circuit 600 is configured to activate the flag signal FLAG when an operating mode is set up. The first detector 830 operates when the flag signal FLAG is inactivated, and the second detector 840 operates when the flag signal FLAG is activated.

As illustrated in FIG. 4, the semiconductor memory device 1000 is configured such that the detectors 830 and 840 having different characteristics from each other operate selectively on the basis of the set-up timing of an operating mode. However, it is to be understood by one skilled in the art that the switch timing of the detectors 830 and 840, is not limited to the set-up time of an operating mode.

Figure 5:
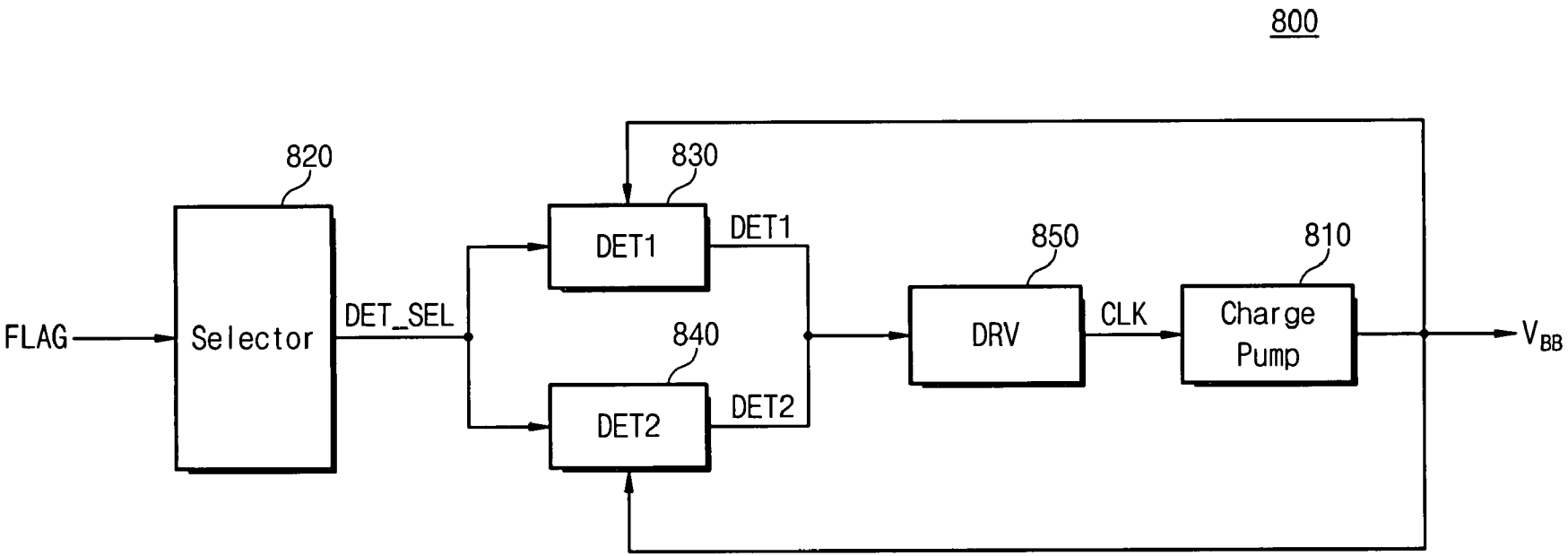
FIG. 5 is a block diagram showing an exemplary embodiment of a substrate bias voltage generating circuit illustrated in FIG. 4.

FIG. 5 is a block diagram showing an exemplary embodiment of the substrate bias voltage generating circuit 800 in FIG. 4.

Referring to FIG. 5, the substrate bias voltage generating circuit 800 comprises a charge pump 810, a selector 820, a first detector 830, a second detector 840, and a driver 850. The charge pump 810 generates the substrate bias voltage $V_{BB}$ in response to a clock signal CLK from the driver 850. The selector 820 generates a selection signal DET_SEL in response to the flag signal FLAG from the control circuit 600. For example, when the flag signal FLAG is at a low level indicating that an operating mode is not set up, the selector 820 generates the selection signal DET_SEL of a low level. When the flag signal FLAG is at a high level indicating that an operating mode is set up, the selector 820 generates the selection signal DET_SEL of a high level.

As illustrated in FIG. 5, the first detector 830 operates in response to the selection signal DET_SEL and detects whether the substrate bias voltage $V_{BB}$ is higher than a negative voltage of a desired level. In addition, the first detector 830 generates a first detection signal DET1 as a detection result.

Figure 1:
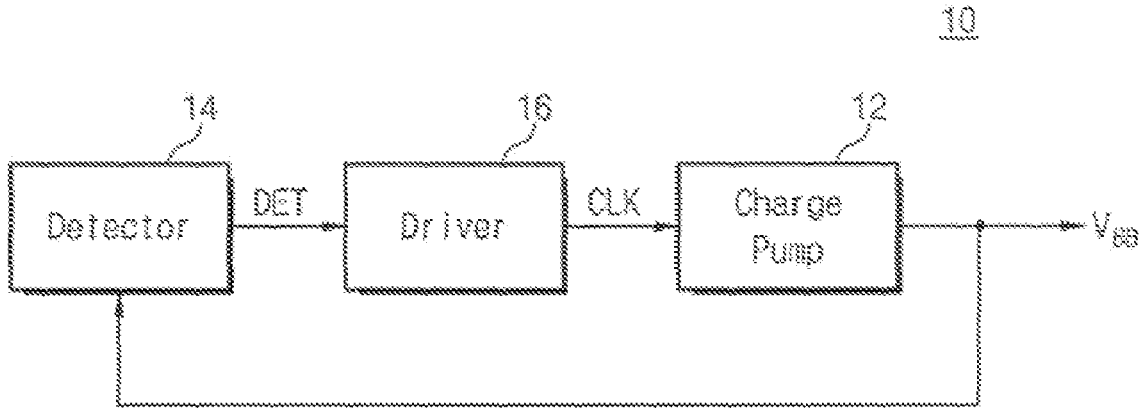
Fig. 1 PRIOR ART
FIG. 1 is a block diagram showing a conventional substrate bias voltage generating circuit.
Figure 2A:
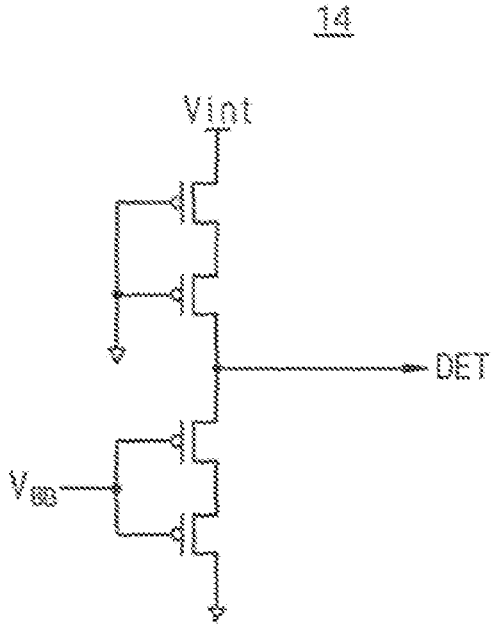
Fig. 2A PRIOR ART
FIGS. 2A and 2B are circuit diagrams showing exemplary embodiments of a detector illustrated in FIG. 1.
Figure 6A:
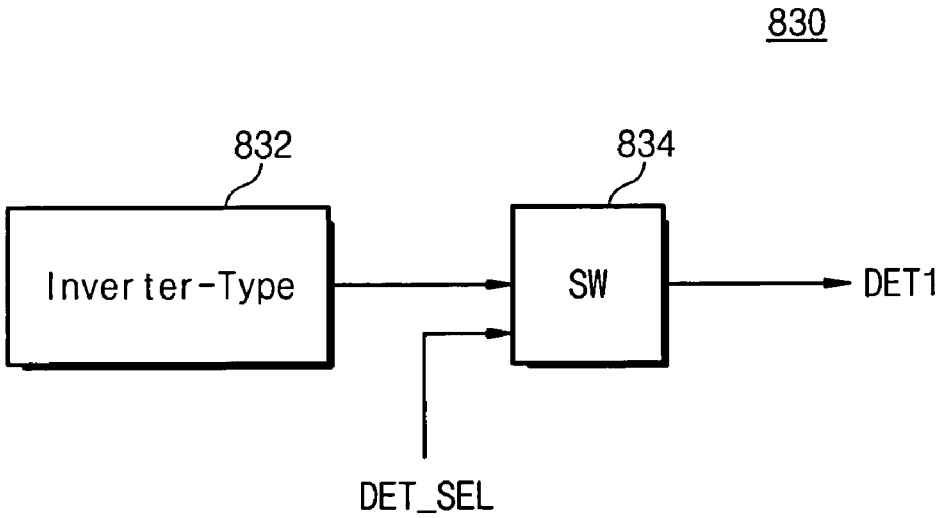
FIG. 6A is a block diagram showing an exemplary embodiment of a first detector illustrated in FIG. 5.

As illustrated in FIG. 6A, the detector 830 comprises an inverter type detection section 832 and a switch 834. The detection section 832 is configured similar to that as illustrated in the detector 14 in FIG. 2A. However, it is to be understood by one skilled in the art that the inverter type detection section 832 is not limited to this.

As further illustrated in FIG. 6A, the switch 834 selectively outputs an output of the detection section 832 as the first detection signal DET1 in response to the selection signal DET_SEL. For example, when the selection signal DET_SEL is at a low level, an output signal of the detection section 832 is output as the first detection signal DET1 through the switch 834. When the selection signal DET_SEL is at a high level, the switch 834 is inactivated such that the output signal of the detection section 832 is not output as the first detection signal DET1.

Returning to FIG. 5, the second detector 840 operates in response to the selection signal DET_SEL, and detects whether the substrate bias voltage $V_{BB}$ is higher than a negative voltage of a desired level. The second detector 840 generates a second detection signal DET2 as a detection result.

Figure 2B:
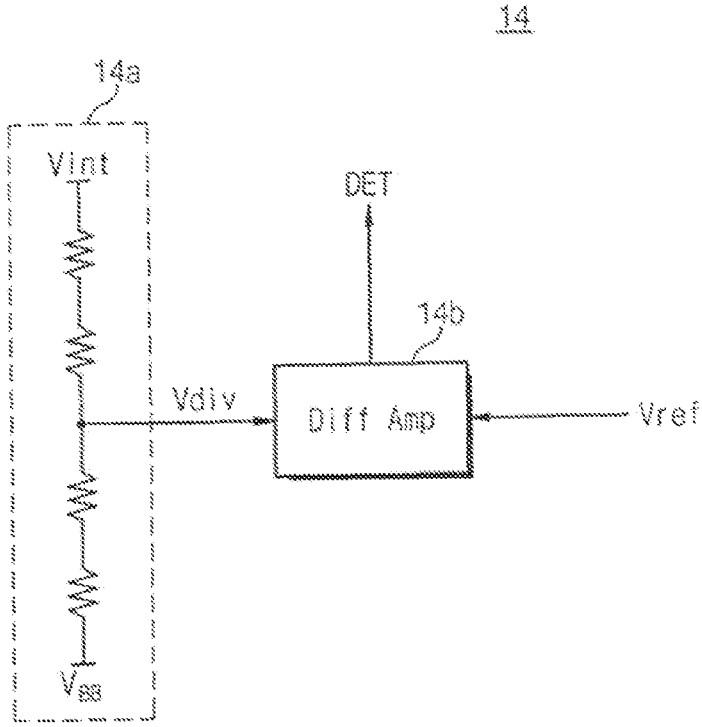
Fig. 2B PRIOR ART
Figure 3:
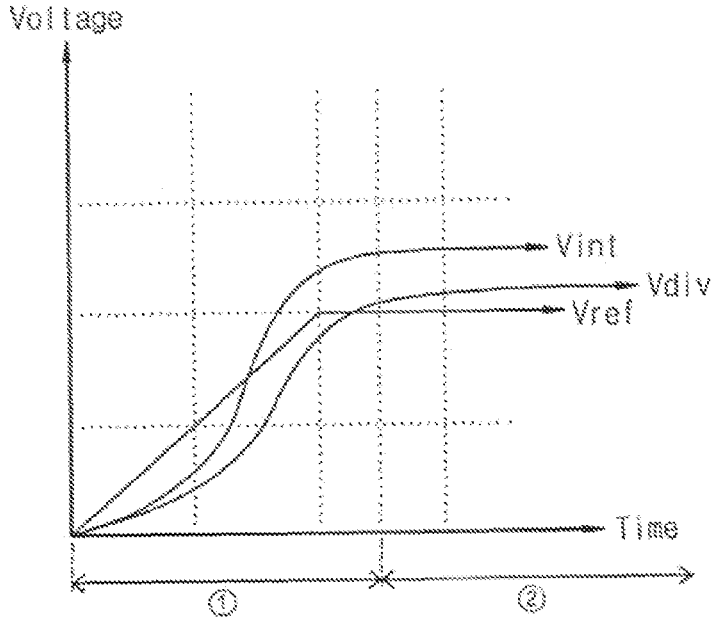
Fig. 3 PRIOR ART
FIG. 3 is a diagram for describing an operating characteristic of a detector illustrated in FIG. 2B.
Figure 6B:
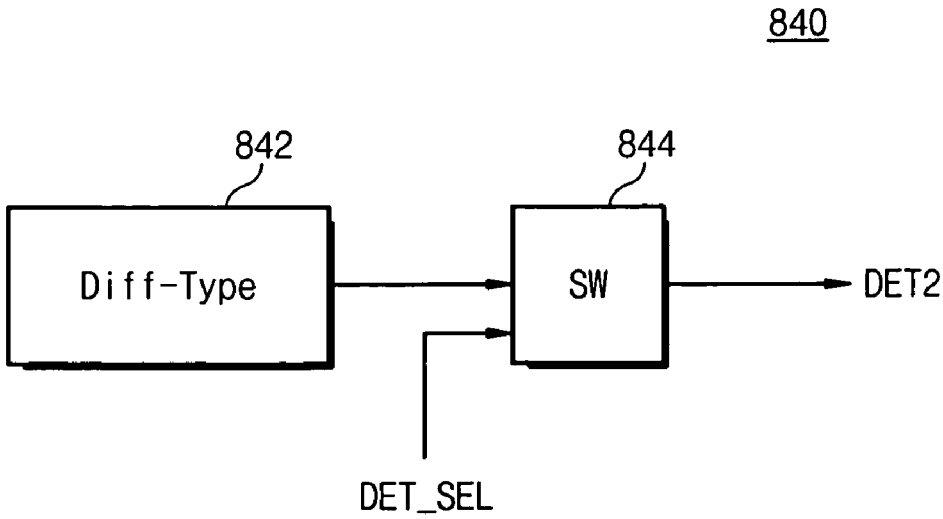
FIG. 6B is a block diagram showing an exemplary embodiment of a second detector illustrated in FIG. 5.

As illustrated in FIG. 6B, the detector 840 comprises a differential amplifier type detection section 842 and a switch 844. The differential amplifier type detection section 842 is configured similar to that as illustrated by the detector 14 in FIG. 2B. However, it is to be understood by one skilled in the art that the differential amplifier type detection section 842 is not limited to this.

As further illustrated in FIG. 6B, the switch 844 selectively outputs an output of the detection section 842 as the second detection signal DET2 in response to the selection signal DET_SEL. For example, when the selection signal DET_SEL is at a high level, an output signal of the detection section 842 is output as the second detection signal DET2 through the switch 844. When the selection signal DET_SEL is at a low level, the switch 844 is inactivated such that the output signal of the detection section 842 is not output as the second detection signal DET2.

Returning again to FIG. 5, the driver 850 generates the clock signal CLK in response to either one of an output from the first and second detectors 840 and 840. As described above, since the first and second detectors 830 and 840 operate complimentarily to each other, either one of output signals from the detectors 830 and 840 is applied to the driver 850.

For example, when the selection signal DET_SEL is at a low level indicating, for example, that an operating mode is not set up, the first detector 830 having the inverter type detection section 832 operates. When the selection signal DET_SEL is at a high level indicating, for example, that an operating mode is set up, the second detector 840 having the differential amplifier type detection section 842 operates.

Accordingly, during a power-up period where an operating mode is not set up, rapid voltage stabilization is accomplished. In addition, during an operating period where the operating mode is set up, a stable substrate bias voltage $V_{BB}$ is maintained in view of temperature variations, due to the use of the detector 840 having the differential amplifier type detection section 842.

In an alternative embodiment, the switch timing of the first and second detectors 830 and 840 can be determined by read/write/refresh/NOP information instead of a command for setting up an operating mode. For example, the read/write/refresh/NOP information can be applied to a control circuit 600 and then to the first and second detectors 830 and 840. In this embodiment, detection levels of the first and second detectors 830 and 840 are determined such that the substrate bias voltage $V_{BB}$ is maintained at a predetermined voltage. However, the detection levels of the first and second detectors 830 and 840 can be defined such that the substrate bias voltage $V_{BB}$ is changed to different voltages when necessary.

Figure 7:
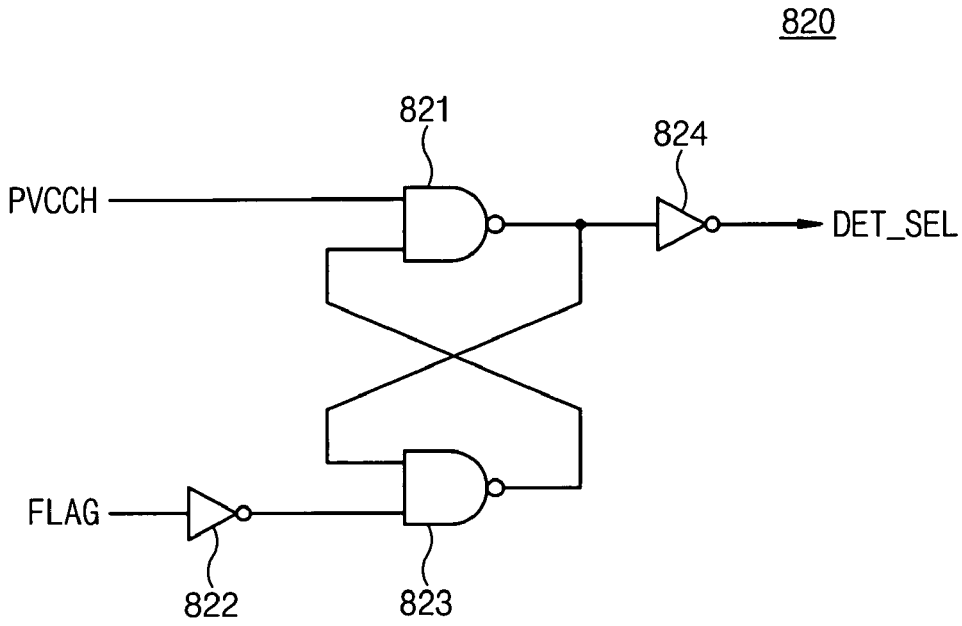
FIG. 7 is a circuit diagram showing an exemplary embodiment of a selector illustrated in FIG. 5.

FIG. 7 is a circuit diagram showing an exemplary embodiment of the selector 820 illustrated in FIG. 5.

Referring to FIG. 7, the selector 820 consists of two NAND gates 821 and 823 and two inverters 822 and 824. The NAND gates 821 and 823 are connected to form an RS flip-flop. The selector 820 is reset by an input signal PVCCH indicating whether an internal power supply voltage reaches a predetermined voltage, and outputs a selection signal DET_SEL of a low level. The low level of the selection signal DET_SEL is maintained until a flag signal FLAG goes to a high level. When the flag signal FLAG has a low-to-high transition, the selection signal DET_SEL is changed to a high level from a low level.

Figure 8:
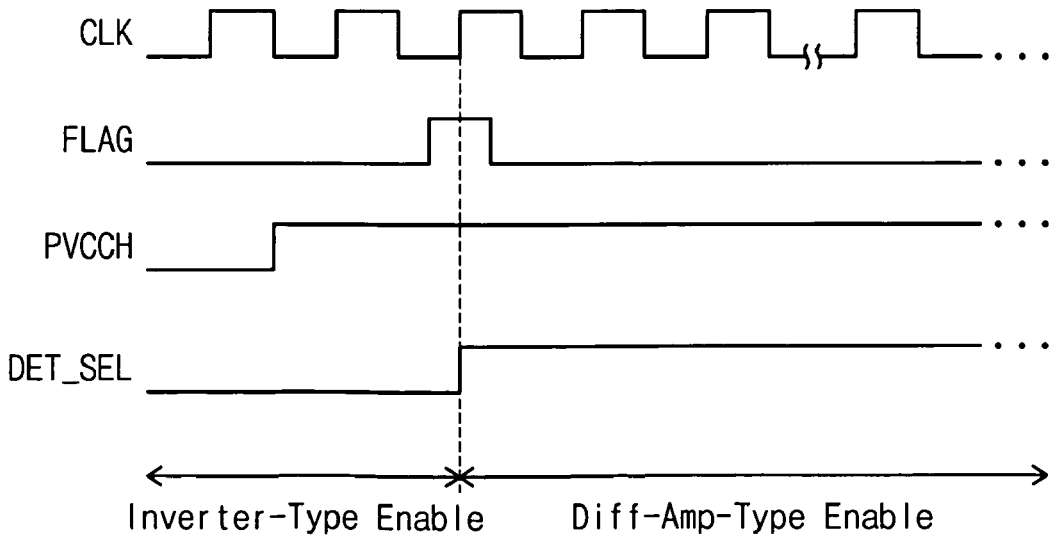
FIG. 8 is a timing diagram for describing an operation of a semiconductor memory device according to an exemplary embodiment of the present invention.

FIG. 8 is a timing diagram for describing an operation of a semiconductor memory device according to an exemplary embodiment the present invention.

As shown in FIG. 8, as an external power supply voltage is supplied, for example, to the semiconductor memory device 1000, an internal power supply voltage Vint and an internal reference voltage start to be generated by an internal voltage generating circuit (not shown).

When the internal power supply voltage Vint reaches a predetermined voltage, a control signal PVCCH goes high. The selector 820 is then reset by a low-to-high transition of the control signal PVCCH. At this time, a flag signal FLAG and a selection signal DET_SEL are maintained at a low level. This means that the first detector 830 is activated and the second detector 840 is inactivated.

The first detector 830 then detects whether a substrate bias voltage $V_{BB}$ is higher than a target voltage, and generates the first detection signal DET1 as a detection result. The driver 850 generates a clock signal CLK in response to the first detection signal DET1, and the charge pump 810 performs a charge pumping operation in response to the clock signal CLK.

At a later time, the control circuit 600 activates the flag signal FLAG to a high level when an operating mode is set up. The selector 820 activates the selection signal DET_SEL in response to the activation of the flag signal FLAG. This means that the first detector 830 is inactivated and the second detector 840 is activated.

The second detector 840 then detects whether the substrate bias voltage $V_{BB}$ is higher than its target voltage, and generates the second detection signal DET2. The driver 850 generates the clock signal CLK in response to the second detection signal DET2, and the charge pump 810 carries out a charge pumping operation in response to the clock signal CLK.

According to the operations just described, the substrate bias voltage $V_{BB}$ is rapidly stabilized by the detector 830 having the inverter type detection section 832 at power-up or before setting-up an operating mode. Further, after power-up or setting-up an operating mode, the substrate bias voltage $V_{BB}$ is constantly maintained by the detector 840 having the differential amplifier type detector 842 even in view of temperature variations.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A substrate bias voltage generating circuit, comprising:

a charge pump for generating a substrate bias voltage in response to a clock signal;

a first inverter type detector for detecting whether the substrate bias voltage reaches a target voltage;

a second differential amplifier type detector for detecting whether the substrate bias voltage reaches the target voltage;

a driver for generating the clock signal in response to an output of one of the first and second detectors; and a selector for generating a selection signal in response to a flag signal indicating whether an operating mode of a memory device is set up, wherein before the operating mode is set up, the first detector detects the substrate bias voltage in response to the selection signal, wherein the first detector comprises:

an inverter type detection section; and a switch connected to the inverter type detection section, the switch for receiving an output of the inverter type detection section and the selection signal and outputting a first detection signal in response to the selection signal.

2. The substrate bias voltage generating circuit of claim 1, wherein the first detector operates when the second detector does not operate and the second detector operates when the first detector does not operate.

3. The substrate bias voltage generating circuit of claim 1, wherein the first detector operates before the operating mode of the memory device is set up.

4. The substrate bias voltage generating circuit of claim 3, wherein the second detector operates after the operating mode of the memory device is set up.

5. The substrate bias voltage generating circuit of claim 1, wherein the selector comprises:

an RS flip-flop;

a first inverter connected to an output of the RS flip-flop; and a second inverter connected to a second input of the RS flip-flop, a first input of the RS flip-flop for receiving an input signal indicating whether a power supply voltage has reached a predetermined voltage, the second inverter for receiving the flag signal and the first inverter for outputting the selection signal.

6. The substrate bias voltage generating circuit of claim 1, wherein after the operating mode is set up, the second detector detects the substrate bias voltage in response to the selection signal.

7. The substrate bias voltage generating circuit of claim 6, wherein the second detector comprises:

a differential amplifier type detection section; and a switch connected to the differential amplifier type detection section, the switch for receiving an output of the differential amplifier type detection section and the selection signal and outputting a second detection signal in response to the selection signal.

8. A semiconductor memory device comprising:

a memory cell array;

a control circuit for generating a flag signal indicating whether an operating mode is set up; and a substrate bias voltage generating circuit for generating a substrate bias voltage to be supplied to the memory cell array in response to the flag signal, wherein the substrate bias voltage generating circuit comprises a first inverter type detector and a second differential amplifier type detector, the first and second detectors selectively operating according to whether the flag signal is generated, wherein the substrate bias voltage generating circuit further comprises:

a charge pump for generating the substrate bias voltage in response to a clock signal;

a driver for generating the clock signal in response to an output of one of the first and second detectors; and a selector for generating a selection signal in response to a flag signal, wherein the selector comprises:

an RS flip-flop;

a first inverter connected to an output of the RS flip-flop; and a second inverter connected to a second input of the RS flip-flop, a first input of the RS flip-flop for receiving an input signal indicating whether a power supply voltage has reached a predetermined voltage, the second inverter for receiving the flag signal and the first inverter for outputting the selection signal.

9. The semiconductor memory device of claim 8, wherein before the operating mode is set up, the first detector detects the substrate bias voltage in response to the selection signal.

10. The semiconductor memory device of claim 9, wherein the first detector comprises:

an inverter type detection section; and a switch connected to the inverter type detection section, the switch for receiving an output of the inverter type detection section and the selection signal and outputting a first detection signal in response to the selection signal.

11. The semiconductor memory device of claim 8, wherein after the operating mode is set up, the second detector detects the substrate bias voltage in response to the selection signal.

12. The semiconductor memory device of claim 11, wherein the second detector comprises:

a differential amplifier type detection section; and a switch connected to the differential amplifier type detection section, the switch for receiving an output of the differential amplifier type detection section and the selection signal and outputting a second detection signal in response to the selection signal.

13. A method for generating a substrate bias voltage, comprising:

receiving, at a selector, a flag signal indicating whether an operating mode is set up;

generating, at the selector, a selection signal in response to the flag signal;

generating, at a charge pump, the substrate bias voltage in response to a clock signal;

detecting, at an inverter type detection section of a first inverter type detector, whether the substrate bias voltage reaches a target voltage, receiving at a switch of the first detector, an output of the inverter type detection section and the selection signal, and outputting, from the switch of the first detector, a first detection signal in response to the selection signal before the operating mode is set up;

detecting, at a differential amplifier type detection section of a second, differential amplifier type detector, whether the substrate bias voltage reaches the target voltage, receiving, at a switch of the second detector, an output of the differential amplifier type dection section and the selection signal, and outputting, from the switch of the second detector, a second detection signal in response to the selection signal after the operating mode is set up; and generating, at a driver, the clock signal in response to the first detection signal or the second detection signal.

14. A substrate bias voltage generating circuit, comprising:

a charge pump for generating a substrate bias voltage in response to a clock signal;

a first inverter type detector for detecting whether the substrate bias voltage reaches a target voltage;

a second differential amplifier type detector for detecting whether the substrate bias voltage reaches the target voltage;

a driver for generating the clock signal in response to an output of one of the first and second detectors; and a selector for generating a selection signal in response to a flag signal indicating whether an operating mode of a memory device is set up, wherein after the operating mode is set up, the second detector detects the substrate bias voltage in response to the selection signal, wherein the second detector comprises:

a differential amplifier type detection section; and a switch connected to the differential amplifier type detection section, the switch for receiving an output of the differential amplifier type detection section and the selection signal and outputting a second detection signal in response to the selection signal.

* * * * *